US005346529A

United States Patent [19]

Pettersson

[11] Patent Number: 5,346,529

[45] Date of Patent: Sep. 13, 1994

[54] POWDERED METAL MIXTURE COMPOSITION

[75] Inventor: Björn O. A. Pettersson, Huntsville, Ala.

[73] Assignee: Tecsyn PMP, Inc., Huntsville, Ala.

[21] Appl. No.: 855,881

[22] Filed: Mar. 23, 1992

[51] Int. Cl.[5] ..... B22F 1/00

[52] U.S. Cl. ..... 75/252; 75/231; 75/246

[58] Field of Search ..... 75/231, 232, 246, 255, 75/252; 419/11, 26, 42, 56

[56] References Cited

U.S. PATENT DOCUMENTS

| | | | |
|---|---|---|---|
| 4,063,940 | 12/1977 | Dain et al. | 75/213 |
| 4,350,530 | 9/1982 | Kamioka | 75/231 |
| 4,452,756 | 6/1984 | McLeod | 419/29 |
| 4,755,222 | 7/1988 | Heinze et al. | 75/246 |
| 4,786,466 | 11/1988 | Holowaty | 420/84 |
| 4,946,499 | 8/1990 | Sakuranda et al. | 75/343 |
| 4,973,356 | 11/1990 | von Holst et al. | 75/233 |
| 5,049,183 | 9/1991 | Saka et al. | 75/244 |
| 5,158,601 | 10/1992 | Fujiki et al. | 75/246 |

FOREIGN PATENT DOCUMENTS

| | | | |
|---|---|---|---|
| 183666A1 | 6/1986 | European Pat. Off. | 75/246 |
| 20906 | 2/1977 | Japan | 75/246 |
| 16155 | 1/1982 | Japan | 75/246 |
| 1580686 | 12/1980 | United Kingdom | 75/246 |

*Primary Examiner*—Donald P. Walsh
*Assistant Examiner*—Ngoclan T. Mai
*Attorney, Agent, or Firm*—John C. Garvin, Jr.; Gary L. Rigney

[57] ABSTRACT

Powdered metal composition consisting essentially of carbon, copper, solid lubricant particles, carbide-enriched alloys and iron and process for sintering to yield alloyed components exhibiting improved mechanical, physical and wear-resistent properties.

1 Claim, No Drawings

POWDERED METAL MIXTURE COMPOSITION

FIELD OF THE INVENTION

This invention relates to the formulation of a composite metal powder and the processing of sintered metal components. More particularly it relates to the composition and processing of a metallic powder exhibiting improved mechanical and physical properties for the fabrication of components requiring high-strength, hardness, and increased wear resistance.

BACKGROUND OF THE INVENTION

In 1958, powder metallurgy was defined by the American Society for Testing and Materials as "the arts of producing metal powders and the utilization of metal powders for the production of massive materials and shaped objects." As a result of the demands imposed upon materials to be used to support high-technology components, powder metallurgy today has become more than just an art and the enhanced properties required of metal components to be utilized by modern technology has advanced its development into a science. The first consideration of powder metallurgy is, of course, the formulation of the powder itself. The characteristics of the final components are determined by the composition of the powder, together with the preparation of the ultimate alloy from elemental powders. Although considerable research has been conducted to develop metal powder compositions exhibiting a wide variety of properties for use in various applications, the specific metal powder composition described herein yields an alloy particularly suitable for the fabrication of components such as cylinder wall inserts for internal combustion engines or bearing surfaces where rigid dimensional tolerances, wear resistance, and elevated surface hardness are required.

It is an object of this invention to formulate a metallic powder which may be processed to provide an alloy exhibiting superior mechanical and physical properties and which provides increased wear resistance.

This and other objects of the invention will become apparent from the description which follows.

As used herein all percents and ratios are by weight unless otherwise indicated.

SUMMARY OF THE INVENTION

Metal powder composition which yields sintered alloyed components having improved mechanical, physical and wear resistant properties consisting essentially of carbon, copper, solid lubricant particles, powdered carbide-enriched alloys and the remainder of the mixture being iron powder wherein said powders are uniformly dispersed in a mixture having an apparent density of 2.4 to 3.5 grams per cubic centimeter.

A process for making the sintered alloy utilizing the metal powder composition is also provided wherein the powdered metal is isostatically compacted, annealed, sintered, and subjected to a controlled cooling profile to obtain a metallic alloy material suitable for the fabrication of machined components.

DETAILED DESCRIPTION OF THE INVENTION

The metal powder composition described herein is comprised of constituents in their respective percentage by weight as shown below.

| CONSTITUENT | % BY WEIGHT |
|---|---|
| graphite | 0.9 to 1.3 |
| copper | 0.8 to 3.0 |
| solid lubricant | 0.01 to 5.0 |
| carbide alloy | 0.01 to 50 |
| iron | up to 98.28% |

The graphite and copper particles are in accordance with a common standard sintering grade which are commercially available. The graphite component is typically composed of 94 to 97% carbon and exhibits a particle size which ranges from 5.0 to 8.0 microns; the particle size for the copper component is less than −325 mesh. The solid lubricant particles may be selected from a group consisting of manganese sulfide (MnS), graphite (C), bismuth (Bi), tellurium (Te) and selenium (Se) which exhibit a particle size typically within the range of 10 to 100 microns. The carbide elements are selected from a group consisting of commercially available tool steel powders conforming with the American Iron and Steel Institute (AISI) specifications for M2, M3, or T15 powders with a particle size on the order of −100 mesh or less. The iron component consists of particles having an approximate particle size which averages −100 mesh with an oxide content less than 0.3% by weight.

Since the properties of compacted and sintered composite materials are dependent upon the thoroughness of the blending process, it is desirable to obtain a uniform dispersion of the constituent materials of the mixture in order to obtain an alloy which exhibits the optimal properties sought. Problems which may occur during mixing are: changes in particle size distribution through grinding or agglomeration, oxidation of particle surfaces, segregation of particle sizes during removal from the mixer or difficulties in obtaining a representative sample.

In this instance, an adequately uniform dispersion of the constituents within the mixture after dry-blending will be demonstrated when a 50 gram sample of the mixture flows through a funnel having an exit orifice of 2.54 millimeters in diameter in a period of 25 to 45 seconds and the mixture possesses an apparent density of 2.4 to 3.5 grams per cubic centimeter.

Upon obtaining a mixture which exhibits the flow rate and apparent density described above, the powder mixture is placed into a mold representing the geometry of the desired component and subjected to an isostatic compaction at a pressure in excess of 60,000 pounds per square inch to achieve a green density in excess of 6.6 grams per cubic centimeter.

Alternatively, another process which may be used to prepare a compacted component for final sintering is to subject the powder mixture within the mold to an isostatic compaction of in excess of 60,000 pounds per square inch, anneal the compacted material at a temperature of approximately 1200° F. to 1500° F. for a period of 10 to 30 minutes or a sufficient period to relieve any internal stresses, and then re-compact the material at a pressure of in excess of 60,000 pounds per square inch.

After having compacted the mixed powder as described above, it may be bonded into a coherent material configuration by sintering. During sintering, the bonding starts at the contact points between the particles where necks are formed by a variety of mechanisms for material transport such as diffusion (surface, volume, and grain-boundary diffusion), plastic flow, and by evaporation and condensation. Some or all of these mechanisms of material transportation can act simultaneously, and the dominant mechanism depends on the powder material, its characteristics, and the sintering conditions (temperature and atmosphere). The migration of the atoms during sintering depends to a large extent on the occurrence of defects (voids) in the crystal lattices. The properties exhibited by a component composed of a sintered mass of powders depend on the sintering conditions, i.e., sintering temperature, sintering time, and the atmosphere of the sintering. To achieve a component exhibiting the desired properties obtainable with the powder mixture described herein, the final component may be sintered in a vacuum, dry hydrogen, nitrogen, or other non-oxidizing atmosphere, at a temperature of 2000° F. to 2200° F. for a minimum period of 20 minutes. Upon the completion of the sintering process, the cooling of the component is controlled at an approximate rate of not less than 0.7° F. /second until the temperature of the component has been lowered to a temperature of not more than 1320° F.

After the sintering process is completed, the component may be then subjected to isostatic, thermal or other sizing process to achieve a final form.

I claim:

1. A powdered metal mixture comprising:

(a) between 0.9 and 1.3% by weight of graphite;

(b) between 0.8 and 3.0% by weight of copper;

(c) between 0.01 and 5.0% by weight of a solid lubricant selected from the group consisting of manganese sulphide, graphite, selenium, bismuth, and tellurium;

(d) up to 98.3% by weight of iron having an average particle size of substantially 100 mesh with an oxide content less than 0.3% by weight; and (e) between 0.01 and 50% by weight of a powdered tool steel alloy selected from those commercially available powders designated by the American Steel and Iron Institute as M2, M3, and T15.

* * * * *